United States Patent [19]

Edwards

[11] 3,934,725

[45] Jan. 27, 1976

[54] NESTABLE ARTICLE

[75] Inventor: Bryant Edwards, Clarendon Hills, Ill.

[73] Assignee: Illinois Tool Works Inc., Chicago, Ill.

[22] Filed: July 2, 1973

[21] Appl. No.: 375,423

Related U.S. Application Data

[63] Continuation-in-part of Ser. No. 233,979, March 13, 1972, abandoned.

[52] U.S. Cl. ..... 206/519; 206/520; 229/1.5 B

[51] Int. Cl.[2] ..... B65D 21/02

[58] Field of Search ..... 206/515, 519, 520; 229/1.5 B

[56] References Cited

UNITED STATES PATENTS

| | | | |
|---|---|---|---|
| 2,808,168 | 11/1967 | Majer | 206/520 |
| 3,437,253 | 4/1969 | Davis | 206/520 |
| 3,443,715 | 5/1969 | Edwards | 206/520 |
| 3,730,385 | 5/1973 | Rost | 206/520 |

FOREIGN PATENTS OR APPLICATIONS

| | | | |
|---|---|---|---|
| 1,432,266 | 12/1968 | Germany | 206/520 |
| 1,965,841 | 12/1969 | Germany | 206/520 |

*Primary Examiner*—George E. Lowrance
*Attorney, Agent, or Firm*—E. L. Benno; R. W. Beart

[57] ABSTRACT

The present invention relates generally to nestable type articles, and more particularly to nestable containers designed to counteract the jamming or wedging of telescopically associated or stacked containers. The invention is particularly useful for one-piece thin-walled plastic containers of the type used in vending machines and comprises a unique wall formation for urging or guiding adjacent identical containers in a nested stack into different rotational positions to insure a positive and substantial stacking abutment between adjacent containers. An embodiment of the present invention disclosed herein includes a one-piece, thin-walled plastic container having a sidewall diverging generally upwardly from the bottom, said container being equipped with novel stacking means comprising upper internal and lower external circumferential stacking sections formed by a series of axially spaced abutments and recesses. The abutments and recesses extend generally axially and radially. Each abutment and recess is defined by axially converging and generally radially extending surfaces. When like containers are in nested or stacked relation, the abutment surfaces will rest in the recesses of the next adjacent container in such a manner as to preclude wedging or jamming of the said containers.

2 Claims, 19 Drawing Figures

11
16a
12a
18a
10a
11
14a 26
10
14
12
30

16a
27a
23
26a
27a
23
28a
25a
10a
12a
20a
22a
14a

16a 23
18a
12a
10a
14a
18a
16a
12a
14a
10a 27a
26a
23
27a
16a
29a
29a
12a
10a
14a

NESTABLE ARTICLE

This application is a continuation-in-part of applicant's application Ser. No. 233,979, filed Mar. 13, 1972, now abandoned.

SUMMARY OF THE INVENTION

Applicant is familiar with the problem of handling nestable or stackable type containers, as evidenced by patents which have heretofore been granted to him. Thus, for example, applicant's Pat. Nos. 3,091,360 and 3,139,213, covering improvements in nestable thin-walled plastic cups, have found extensive commercial acceptance in instances where such cups are to be shipped or vended in stacked relation. Pertinent prior art containers have generally used reverse taper in a wall of the container or have relied upon accidental rotational misalignment of adjacent cups in a stack to prevent such thin-walled containers from jamming or wedging in transport or handling. The subject invention without requiring the use of reverse taper provides a wall configuration which insures rotational mis-alignment of adjacent containers in a stack.

More specifically, the present invention contemplates a unique and very practical arrangement whereby containers, as for example thin-walled plastic cups, may be telescopically associated or nested without the potential hazard of wedging or jamming.

It is a further object of the present invention to provide a nestable type container of the type referred to above in which the novel structural characteristics are such that, in order to effect complete nesting of one container within another, a predetermined degree of relative rotation between said containers is necessitated.

The present invention further contemplates an improved and highly practical nestable container or cup of the type set forth above, wherein the aforesaid relative rotation is automatically effected by a novel arrangement of cam or guiding surfaces.

The present invention contemplates nestable type containers of the type referred to above, wherein a unique stacking section is incorporated in the container which may be positioned at the top of the container, in the bottom of the container or intermediate the top and bottom of the container in the side wall.

It is also an important object of the present invention to provide a uniquely designed "non-jammable" nestable article which may be produced by the practice of available molding or forming methods. Examples of such articles are bottle caps and other covers. Examples of materials other than plastics are metal foils, paper and composite materials.

BRIEF DESCRIPTION OF THE DRAWINGS

The foregoing and other objects and advantages will be more apparent from the following detailed description when considered in connection with the accompanying drawings wherein.

DESCRIPTION OF THE PREFERRED EMBODIMENTS OF THE INVENTION

Figure 1:
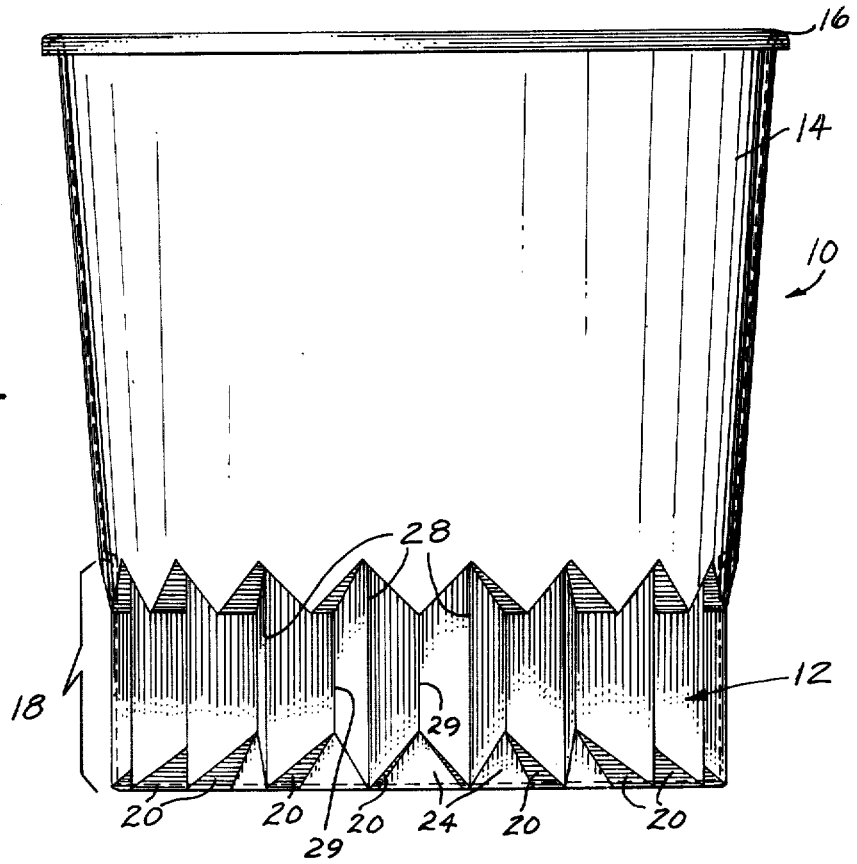
FIG. 1 is a side elevational view of a container having the novel st. .king arrangement contemplated by the present invention.
Figure 2:
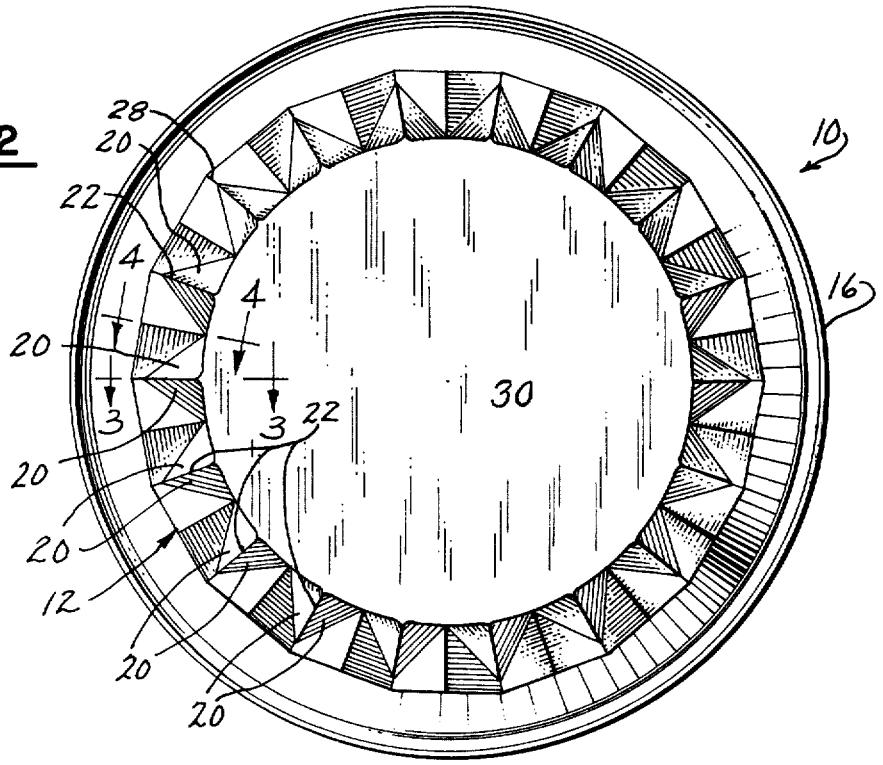
FIG. 2 discloses the container as viewed from the underside of the disclosure in FIG. 1.
Figure 3:
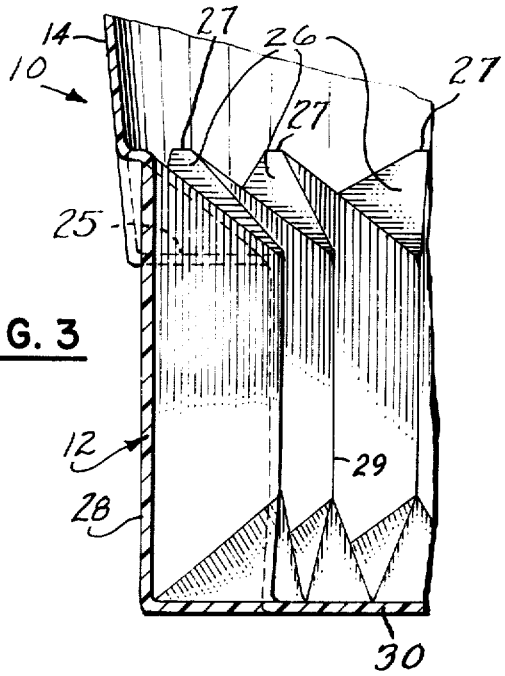
FIG. 3 is a fragmentary enlarged vertical sectional view of a bottom section of the container, taken substantially along the line 3—3 of FIG. 2.
Figure 6:
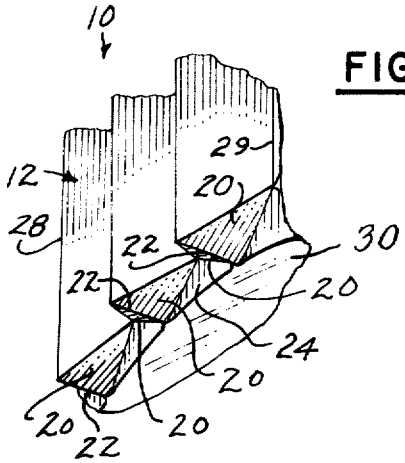
FIG. 6 is a fragmentary perspective view disclosing a section of the bottom periphery of the container of FIG. 1.
Figure 4:
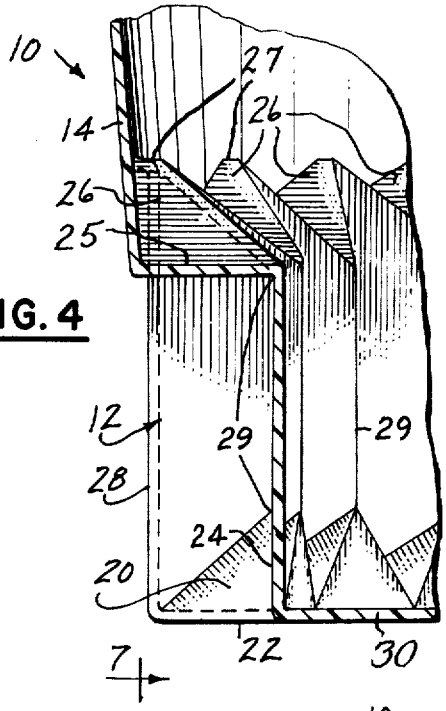
FIG. 4 is also an enlarged fragmentary vertical sectional view of the lower portion of the container, taken substantially along the line 4—4 of FIG. 2.

Referring now to the drawings more in detail, wherein like numerals have been employed to designate similar parts throughout the various views, FIG. 1 discloses a side elevational view of a thin wall plastic container designated generally by the numeral 10, said container at its lower extremity being provided with circumferential stacking means designated generally by the numeral 12. A wall section 14 of the container 10 diverges generally upwardly and outwardly to an upper rim 16 defining the open end of the container.

In the disclosed embodiment, the stacking means 12 is positioned at the lower extremity of the container and has an over-all vertical extent indicated by the bracket 18 in FIG. 1. A lower external section of the stacking means 12 comprises a plurality of circumferentially distributed, generally triangular-shaped abutment surfaces 20 which diverge upwardly from bottom radial lines of intersection 22. Each pair of surfaces 20 terminate inwardly in wall portions 24.

Figure 7:
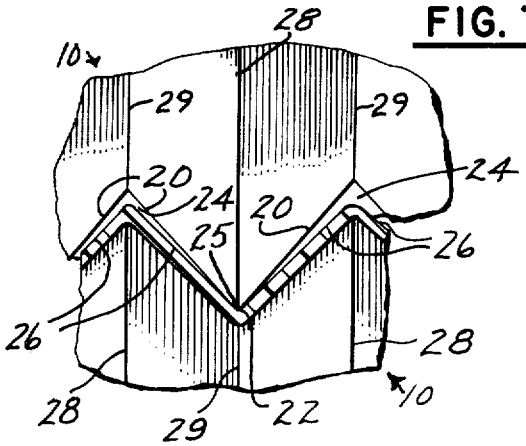
FIG. 7 is a detailed vertical sectional view, taken substantially along the line 7—7 of FIG. 5, more clearly to illustrate the manner in which the lower external stacking section or abutment of one container nests within the internal upper stacking section or recess of a companion container.

The upper internal section of the stacking means 12 comprises a plurality of pairs of generally triangularly-shaped internal recess surfaces 26, which converge downwardly and extend radially inwardly from the inner surface of the sidewall 14. The recess surfaces 26 of each pair intersect at 25 at the lower ends thereof, and the extreme upper ends of adjacent pairs intersect on the line 27. Pairs of the converging recess surfaces 26 define downwardly and radially extending recesses for interlockingly accommodating complementary pairs of external abutment surfaces 20 of a like container. These internal recess surfaces 26 extend inwardly from the inner surface of the container wall 14 and define a series of circumferentially positioned, downwardly and radially extending recesses spaced upwardly from and circumferentially offset from the aforesaid abutment surfaces 20 of the lower stacking section. Thus, as illustrated in FIG. 7, when like containers are in completely nested relation each of the internal recess surfaces 26 are adapted to accommodate complementary upwardly diverging abutment surfaces 20 of the lower stacking section. In other words, the recess surfaces 26 of one container at the line 25 serve as a support or shelf for the lower abutment surfaces 20 of the other container.

It will also be apparent from the foregoing description that in a stack of nested containers, each pair of upwardly diverging abutment surfaces 20 is in vertical alignment with a complementary pair of the downwardly converging recess surfaces 26.

Figure 5:
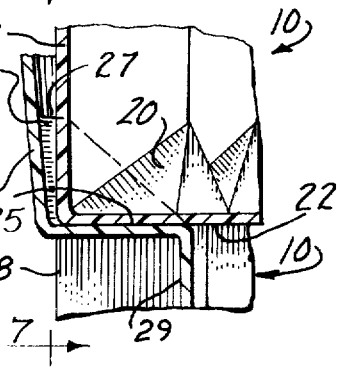
FIG. 5 is a fragmentary vertical sectional view disclosing the portion of the container illustrated in FIG. 3 nested within the portion of the container illustrated in FIG. 4.

In each container a rib 28 extends upwardly from the radially outward end of line 22 to the inner end of line 27. If desired the ribs 28 may be inclined upwardly and inwardly to produce a longer line 27 for more positive guiding in the stacking operation of complementary containers. Further, in each container, a rib 29 extends upwardly from the upper end of wall portion 24 to the inner end of the line 25. The ribs 29 and 28 are interconnected through obvious wall portions producing a fluted configuration circumferentially of the container. By reasons of this construction the outer peripheral extremities of the diverging abutment surfaces 20 terminate within a concentric circle of the container 10 having a diameter not in excess of and preferably slightly less than the internal diameter of the container sidewall surface adjacent the line or intersection 25 of recess surfaces 26, and further having a diameter greater than the diameter of a circle defined by the radially inward ends of the lines 27. From the disclosure in FIG. 5, it will be apparent that there is no contact of the ribs 28 of the stacking means 12 with the inner surface of the container sidewall 14. Each pair of external abutment surfaces 20 engage and interact with a portion of a complementary pair of internal recess surfaces 26 in such a manner as to assure complete and concentric nesting in a stack.

Figure 8:
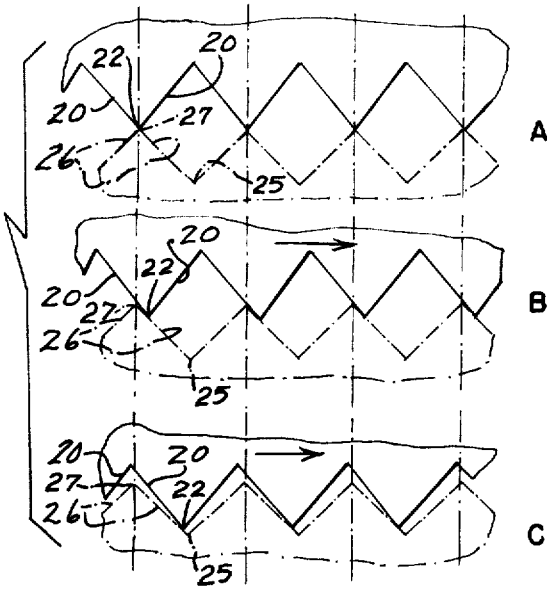
FIG. 8 diagramatically illustrates in three steps designated by the letters A, B and C, the progressive camming or guiding action which causes relative rotation between telescopically associated containers as they move automatically into complete nesting relation.

The abutment surfaces 20 and the recess surfaces 26 function as cam or guiding surfaces in effecting the complete nesting of containers 10. This camming feature is diagrammatically illustrated in FIG. 8. The lower section of the stacking means 12 is illustrated by solid lines and the upper section of said stacking means is represented by dot-and-dash lines. In the diagram A of FIG. 8, the lower horizontal lines of intersection 22 of the surfaces 20 are shown in contact with the upper line 27 between adjacent recess surfaces 26. Obviously, because of the line to line contact the upper container will not remain in this position but will be rotatably guided either to the left or to the right. In the diagram B of FIG. 8, the upper container is shown as initially shifting to the right, due to the camming coaction of the above-mentioned abutment and recess surfaces. In the diagram C, the upper container is illustrated as approaching its final position of complete nesting.

The recess surfaces 26 of the upper stacking section and the abutment surfaces 20 of the lower stacking section in the aggregate present a circumferential series of axially spaced inclined converging and diverging surfaces. From the inner end of lines 27, the recess surfaces 26 extend downwardly and inwardly to ribs 29. From the outer end of line 22, the abutment surfaces 20 extend upwardly and inwardly to ribs 29. From the foregoing description of the inclinations of the abutment surfaces 20 and recess surfaces 26, it will be apparent that the necessary circumferential offset of those surfaces is accomplished. Thus, the abutment surfaces 20 and recess surfaces 26 cooperate as cams in effecting relative rotation between telescopically associated containers, thereby assuring automatic engagement of the abutment surfaces 20 with the shelf means provided by the recess surfaces 26. In this final position of nesting, the containers are secured against further relative rotation and are also concentrically nested with sufficient clearance between the inner surface of the sidewall 14 and the ribs 28 to preclude any possibility of jamming. In the disclosed embodiment, the included angle of each pair of diverging, abutment and converging recess surfaces is substantially ninety degrees, thereby avoiding wedging engagement of said surfaces. While the present invention is not necessarily limited to the use of an included angle of 90°, said included angle must be such as to avoid any tendency for the contacting surfaces to wedge or jam. In the disclosed embodiment of the invention, see particularly FIG. 7, the included angle of the upwardly diverging abutment surfaces 20 is slightly less than the included angle of the downwardly converging recess surfaces 26. As a result, only the lower portions of the abutment surfaces 20 and recess surfaces 26 are in contact with each other when the containers are completely nested. This angular relationship of the abutment and recess surfaces serves to facilitate complete container nesting.

Figure 8A:
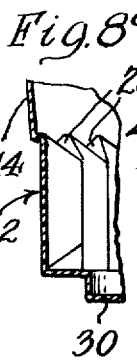
FIG. 8A is a fragmentary vertical sectional view similar to FIG. 3 and discloses a modified bottom portion.
Figure 11:
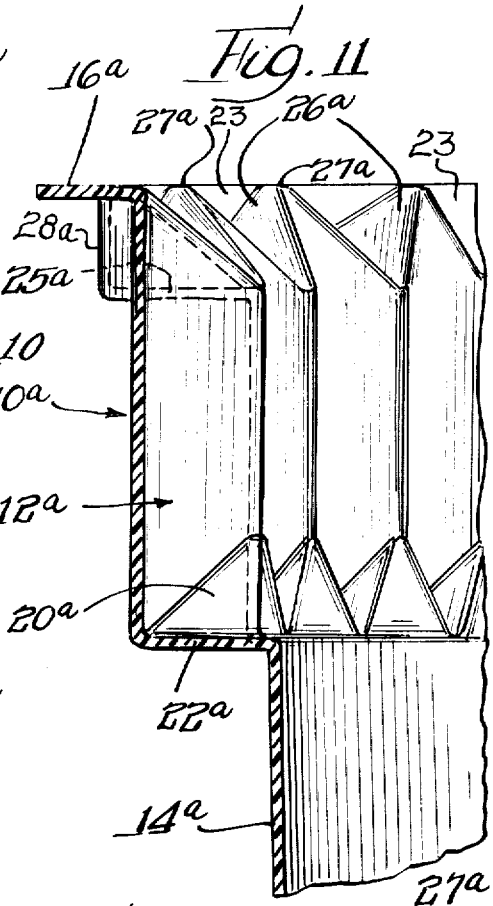
FIG. 11 is an enlarged fragmentary detailed sectional view taken substantially along the line 11—11 of FIG. 9.

In FIGS. 1 to 8 inclusive the bottom section of the container 10 is identified by the numeral 30. In FIG. 8*a* the container bottom 30 is positioned below the plane coincident with the bottom lines of intersection of the abutment surfaces 20. This construction serves to shield the lateral strength to the lines of intersection 22 from damage in handling.

In FIGS. 9 to 12 inclusive a container is designated generally by the numeral 10*a* and is provided with circumferentially disposed stacking means designated generally by the numeral 12*a*. A wall section 14*a* of the container 10*a* diverges generally upwardly and outwardly and a rim 16*a* is positioned immediately adjacent the upper margin of the stacking means 12*a*. The stacking means 12*a* is structurally identical with the previously described stacking means 12 but is located at the upper extremity of the container as distinguished from the stacking means 12 which is located at the lower extremity of the container. The structural details of the stacking means 12*a* corresponding with structural details of the previously described stacking means 12 are identified by similar numerals bearing the suffix *a*.

Figure 9:
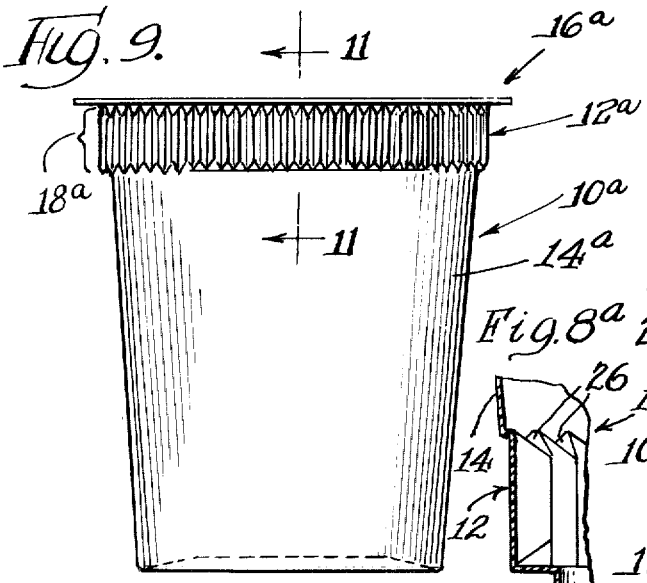
FIG. 9 is an elevational view of the container having a stacking section of the present invention located at the upper extremity of a container.
Figure 10:
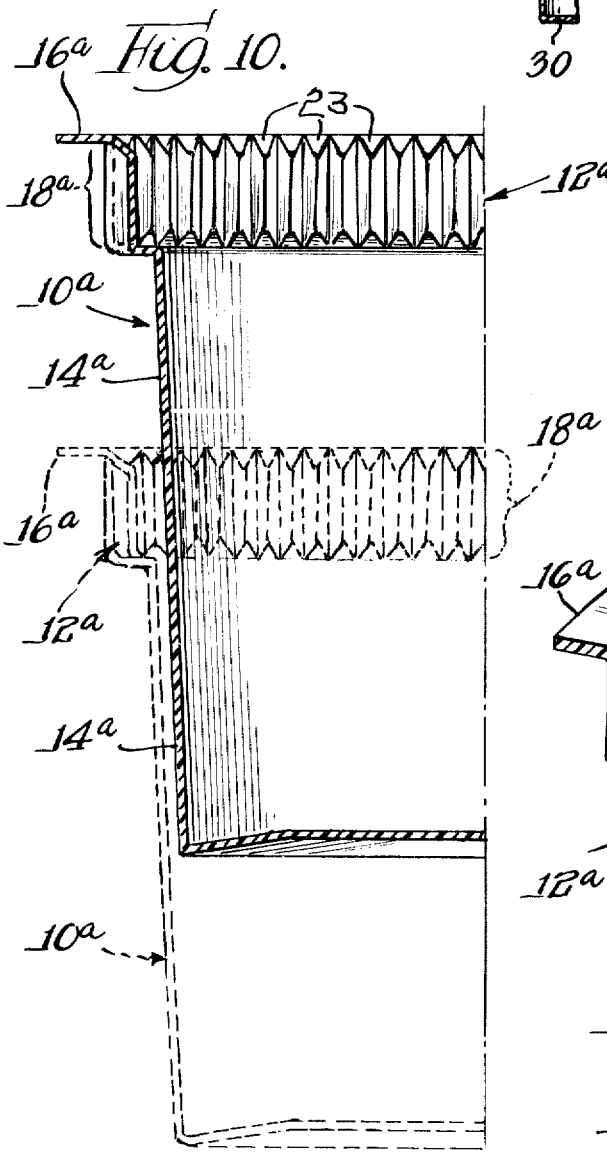
FIG. 10 is a fragmentary, central, vertical sectional view of the container disclosed in FIG. 9 having associated therewith a like container illustrated in dotted lines said container being disclosed in partial telescopic association.
Figure 12:
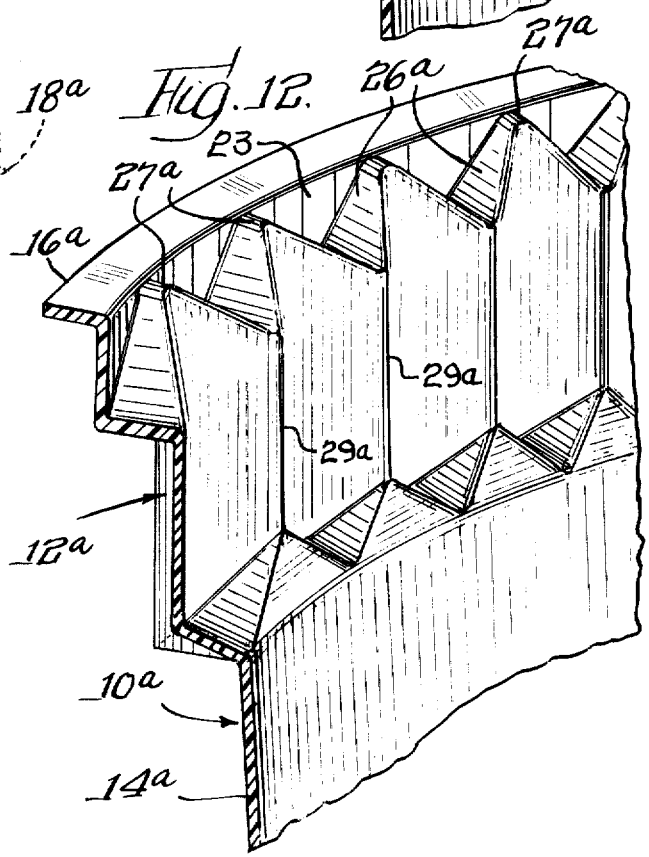
FIG. 12 is a fragmentary perspective view of the stacking section illustrated in FIG. 11.

The stacking means 12 has an overall vertical extent indicated by the bracket 18*a* in FIGS. 9 and 10. The lower external portion of the stacking means 12*a* comprises a plurality of circumferentially distributed, generally triangularly shaped abutment surfaces 20*a* which diverge upwardly from bottom radial lines of intersection 22*a*, FIG. 11.

The upper internal portion of the stacking means 12*a* comprises a plurality of pairs of generally triangularly shaped internal recess surfaces 26*a* which converge downwardly from lines 27*a* to lines 25*a* and extend radially inwardly from the inner surface of the sidewall portions 23. Pairs of the converging recess surfaces 26*a* define downwardly and radially extending recesses for interlockingly accommodating complementary pairs of external abutment surfaces 20*a* of a like container. The internal recess surfaces 26*a* extend inwardly from the inner surface of the container wall portion 23 and define a series of circumferentially positioned, radially extending recesses spaced upwardly from and between the external abutment surfaces 20*a*. When like containers 10*a* are in completely nested relation, the lower diverging abutment surfaces 20*a* of the upper container will interlock with the upper converging recess surfaces 26*a* of the container positioned therebeneath in the manner illustrated in FIGS. 5 and 7 relating to the previously described containers 10. It will be apparent from the foregoing that the only significant structural difference between the stacking means 12*a* of the containers 10*a* and the stacking means of the containers 10 is in the location thereof.

Figure 13:
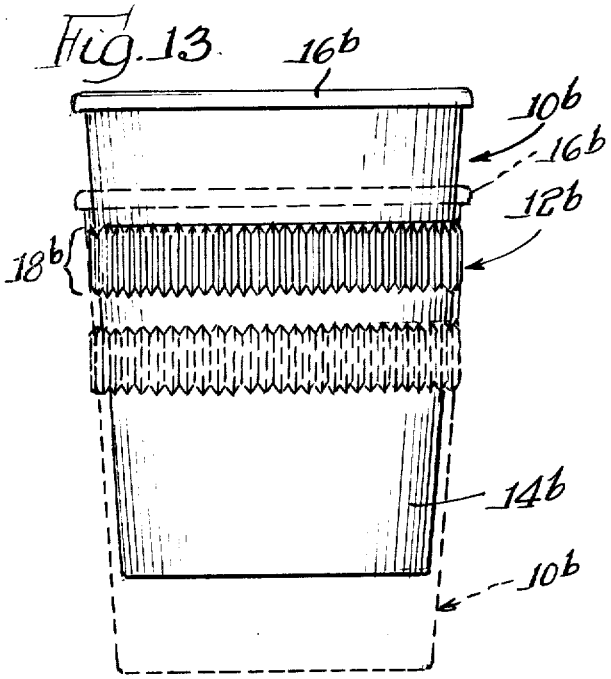
FIG. 13 is an elevational view of a container having a stacking section of the present invention located intermediate the upper and lower extremities of the container, a like container shown by dotted lines being illustrated in partial telescopic association therewith.
Figure 14:
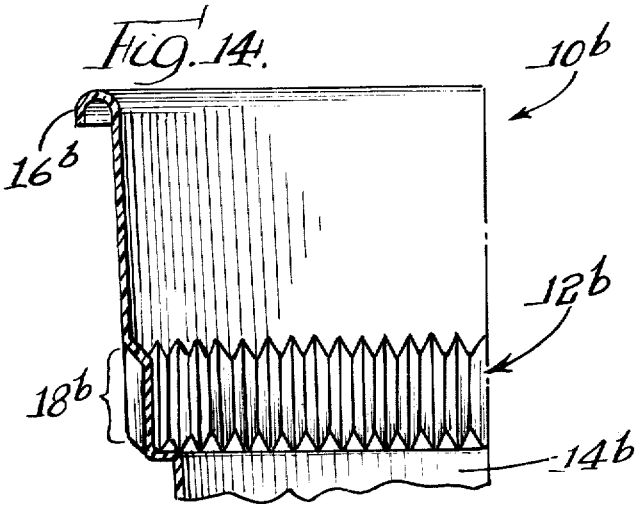
FIG. 14 is a fragmentary central vertical sectional view of the upper portion of the container shown in FIG. 13.

In FIGS. 13 and 14, a container is illustrated and identified generally by the numeral 10*b*. The only structural difference between the container 10*b* and the containers 10–10*a* is in the location of the stacking means designated by the numeral 12*b*. It will be seen that the stacking means 12*b* is located intermediate the upper and lower extremities of the container 10b. Thus, the bottom abutment surfaces of the stacking means 12*b* of an upper container will interlock with complementary upper recess surfaces of a like nested lower container in the manner herebefore described. The axial extent of the stacking means 12*b* is indicated by the bracket 18*b* and the rim at the upper extremity of the container wall 14*b* is indicated by the numeral 16*b*.

Figure 15:
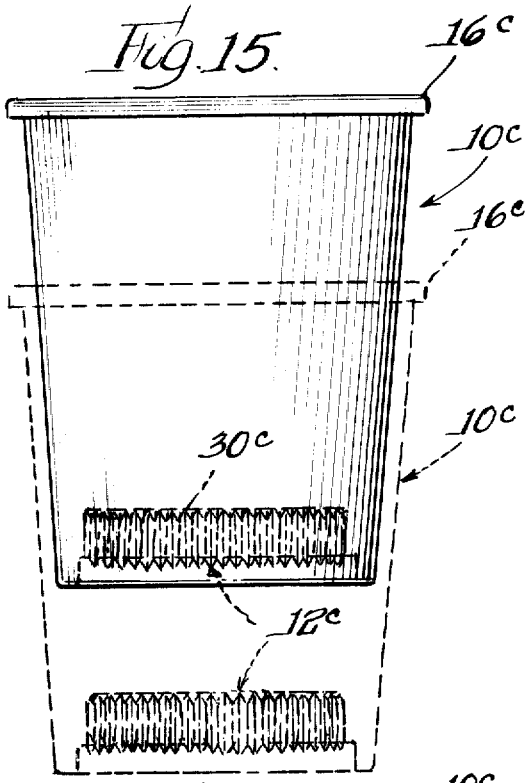
FIG. 15 is an elevational view of a container having a stacking section of the present invention located in the bottom of a container.
Figure 16:
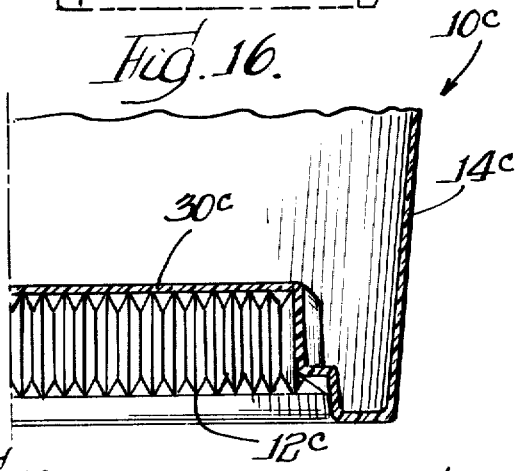
FIG. 16 is a fragmentary central vertical sectional view of the bottom portion of the container shown in FIG. 15.

In FIGS. 15 and 16, a container designated generally by the numeral 10c is shown which includes a stacking means designated generally by the numeral 12*c* and disposed in the bottom of the container 10*c*. The container 10*c* comprises an upwardly flaring wall 14c and an upper rim 16*c*. The stacking means 12 is formed in the container wall 14 whereas the stacking means 12*c* is formed in a bottom reentrant section 30*c*. The stacking means 12*c* is structurally identical with the previously described stacking means 12, 12*a*, and 12*b* except that it is inverted and thus the previously described upwardly diverging abutment surfaces are downwardly diverging abutment surfaces and the previously described downward converging recess surfaces are upwardly converging recess surfaces. By having the stacking means 12*c* thus formed in the reetrant bottom section 30*c*, said stacking means is somewhat shielded against damage which might otherwise result from inadvertent contact therewith and the outer sidewall of the container is undisturbed.

Figure 17:
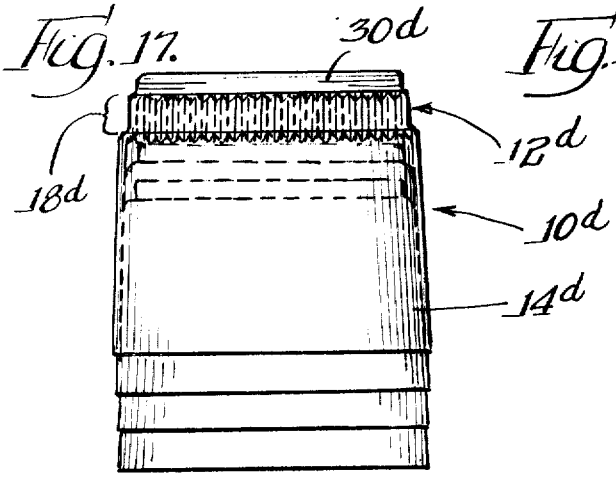
FIG. 17 discloses a plurality of stacked cover elements for incapsulating the upper extremity of a bottle and having a stacking section constructed in accordance with the teachings of the present invention.
Figure 18:
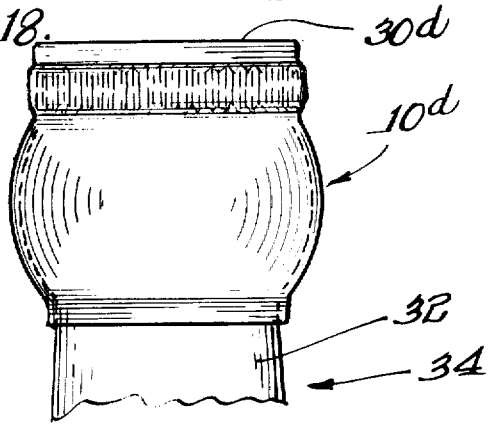
FIG. 18 discloses one of the stacked cover members of FIG. 17 crimped in position upon the upper extremity of a bottleneck.

In FIGS. 17 and 18 a modified shallow cover 10*d* is shown. This cover 10*d* may be used as a "crimped-on" sealing cap for the upper extremity of the neck 32 of a bottle 34. It will be noted that the cover 10d is provided with stacking means 12*d* at the closed extremity thereof. The arrangement of abutment and recess surfaces forming the stacking means 12*d* is identical with the previously described arrangement of abutment surfaces of the container 10 except in reference to the upward and downward directions. This permits nesting of one cover within another as illustrated in FIG. 17 to conserve space in storage and shipping of such covers prior to application. Extending axially beyond the stacking means 12*d* and forming a closure for one end of the cover 10*d* is a top section 30*d*. Each of the covers 10*d* includes a wall section 14*d* and the stacking means 12*d* is of relatively short axial extent as indicated by the bracket 18*d*. In instances where it is found desirable, the covers 10*d* may be formed of suitable material such as relatively thin metal. After one of the members 10*d* has been initially associated telescopically with the upper end of the bottleneck 32, it may be crimped into tight sealing engagement as clearly illustrated in FIG. 18. Devices such as covers 10*d* may be compactly nested without the potential hazard of jamming in a manner similar to that described in connection with the containers 10, 10*a*, 10*b* and 10*c*.

It should be understood that the vertical extent of the stacking section may be varied to meet the needs incident to the use thereof. Also, the number, size and shape of the complementary abutment and recess surfaces may vary from the disclosure as herein described without departing from the spirit and scope of the present invention. The one piece containers 10, 10*b*, and 10*c* are so designed as to enable the economic production thereof by practicing available plastic molding and forming methods. The invention contemplates that the containers 10, 10*b* and 10*c* may also be formed of other materials such as metal foils, papers or composite materials.

As herein set forth, the improved stacking means of the present invention may also be employed to facilitate stacking of plyable, metallic devices which serve in one example as seals for the open extremity of bottles and the like. Thus, the above described stacking means is adapted for use with various nestable devices to preclude jamming of such devices when in nested relation.

The present invention contemplates structural changes and modifications without departing from the spirit and scope of the appended claims.

I claim:

1. In a generally nestable article which is formed from a substantially uniform thickness sheet material, the improvement of stacking means which permits non-jamming nesting of a plurality of identically formed such articles for the storage and transport of said articles in nested stacks, said stacking means formed in a wall of said article and comprising a series of contiguous stacking abutments each comprising a pair of planar surfaces angularly arranged relative to each other and to the axial direction of nesting of said articles and said abutments being continuously circumferentially arranged in said wall of said article and extending in a radial direction, a series of contiguous stacking recesses each comprising a pair of planar surfaces angularly arranged relative to each other and to the axial direction of nesting of said articles and said recesses being continuously circumferentially arranged in said wall with adjacent recesses having a portion thereof meeting on a juncture line extending in a radial direction opposite from the radial direction of said stacking abutments, said stacking recesses further being axially spaced and circumferentially offset from said stacking abutments, and said juncture lines forming a series of guiding means in said wall at the line of contiguity of said stacking recesses and extending in the same radial direction as said stacking recesses for engaging and guiding the stacking abutments of a like article into stacking cooperation with said stacking recesses during telescopic concentric nesting of said like article therein.

2. In a generally nestable article which is formed from a substantially uniform thickness sheet material, the improvement of stacking means which permits non-jamming nesting of a plurality of identically formed such articles for the storage and transport of said articles in nested stacks, said stacking means formed in a wall of said article and comprising a series of contiguous pairs of generally triangularly shaped stacking abutment surfaces continuously circumferentially arranged in said wall of said article and extending in one radial direction, the abutment surfaces of each pair being arranged at an angle to each other and inclined to the axial direction of nesting of said articles and joined on a common abutment line which extends in said one direction, adjacent pairs of said abutment surfaces being contiguous at said wall, a series of contiguous pairs of generally triangularly shaped stacking recess surfaces continuously circumferentially arranged in said wall of said article and extending in the opposite radial direction from said one radial direction, the recess surfaces of each pair being arranged at an angle to each other and inclined to the axial direction of nesting of said articles and joined on a common recess line which extends in said opposite radial direction, said pairs of recess surfaces further being axially spaced and circumferentially offset from said pairs of abutment surfaces, adjacent pairs of said recess surfaces being contiguous on a juncture line which extends from said wall in said opposite radial direction, a plurality of generally axially extending first ribs, each of said first ribs extending between the radially extending end of one of said abutment lines and the radially extending end of one of said juncture lines, and a plurality of generally axially extending second ribs, each of said second ribs extending between one of the junctions of adjacent pairs of abutment surfaces and the radially extending end of one of said recess lines.

* * * * *